United States Patent [19]

Elston

[11] 4,334,487

[45] Jun. 15, 1982

[54] METHOD OF MANUFACTURING COMPOSITE CONTAINERS

[75] Inventor: Jay T. Elston, Urbana, Ohio

[73] Assignee: Kardon Industries, Inc., Philadelphia, Pa.

[21] Appl. No.: 111,618

[22] Filed: Jan. 14, 1980

[51] Int. Cl.[3] ..... B21D 51/16

[52] U.S. Cl. ..... 413/6; 72/374

[58] Field of Search ..... 113/120 N, 120 A, 120 K, 113/121 C, 121 E, 121 A, 116 DD, 1 G, 120 M, 1 E

[56] References Cited

U.S. PATENT DOCUMENTS

| | | | |
|---|---|---|---|
| 1,340,449 | 5/1920 | Keeran | 113/121 A |
| 3,204,847 | 9/1965 | Vitense | 113/120 N X |
| 4,207,761 | 6/1980 | Niemi | 113/120 M X |

*Primary Examiner*—Mark Rosenbaum

*Attorney, Agent, or Firm*—Benasutti Associates, Ltd.

[57] ABSTRACT

This invention relates to method for manufacturing composite containers. The containers of the preferred embodiment are especially adapted for dispensing food stuffs.

1 Claim, 2 Drawing Figures

METHOD OF MANUFACTURING COMPOSITE CONTAINERS

BACKGROUND OF INVENTION

Field of the Invention

The present invention relates to the field of composite can or container manufacturing and to the field of food stuff composite can or container manufacturing. More particularly, the present invention relates to food stuff containers which incorporate a dispensing tip for applying the food stuff and a plunger for urging the food stuff from the container.

In the composite container industry it has been traditional for the manufacturer of the container to affix to one end of the container a sealed closure prior to shipping the container to the end user. The end user would then fill the container with the given product and seal the container with a second closure. It has been traditional in the industry for the container manufacturer to attach the more troublesome closure prior to sending the container to the end user. This has been expecially true in applications such as dispensing containers wherein a dispensing tip, diffuser or snout is located on the end of the container. Accordingly, in traditional manufacturing techniques the composite container manufacturer would assemble the snout or tip closure to the container and forward the assembly to the end user.

SUMMARY OF THE INVENTION

The present invention relates to a composite container having a ring and plunger closure on one end thereof and a method for manufacturing the same. The applicant has assembled the manufacturing stations to achieve a compact assembly operation which reduces transportation of the container from one remote manufacturing area to another. Additionally, the applicant has affixed to one end a breakable seal closure having a plunger member which is used to urge the contents from the container. The composite container produced by the present method provides an advantage over prior art containers, in that it is more compact and less difficult to handle.

It is, therefore, an object of this invention to provide a compact composite container.

It is a further object of this invention to provide a compact composite container, having a breakable seal closure on one end thereof.

DESCRIPTION OF THE PREFERRED EMBODIMENT

Figure 1:
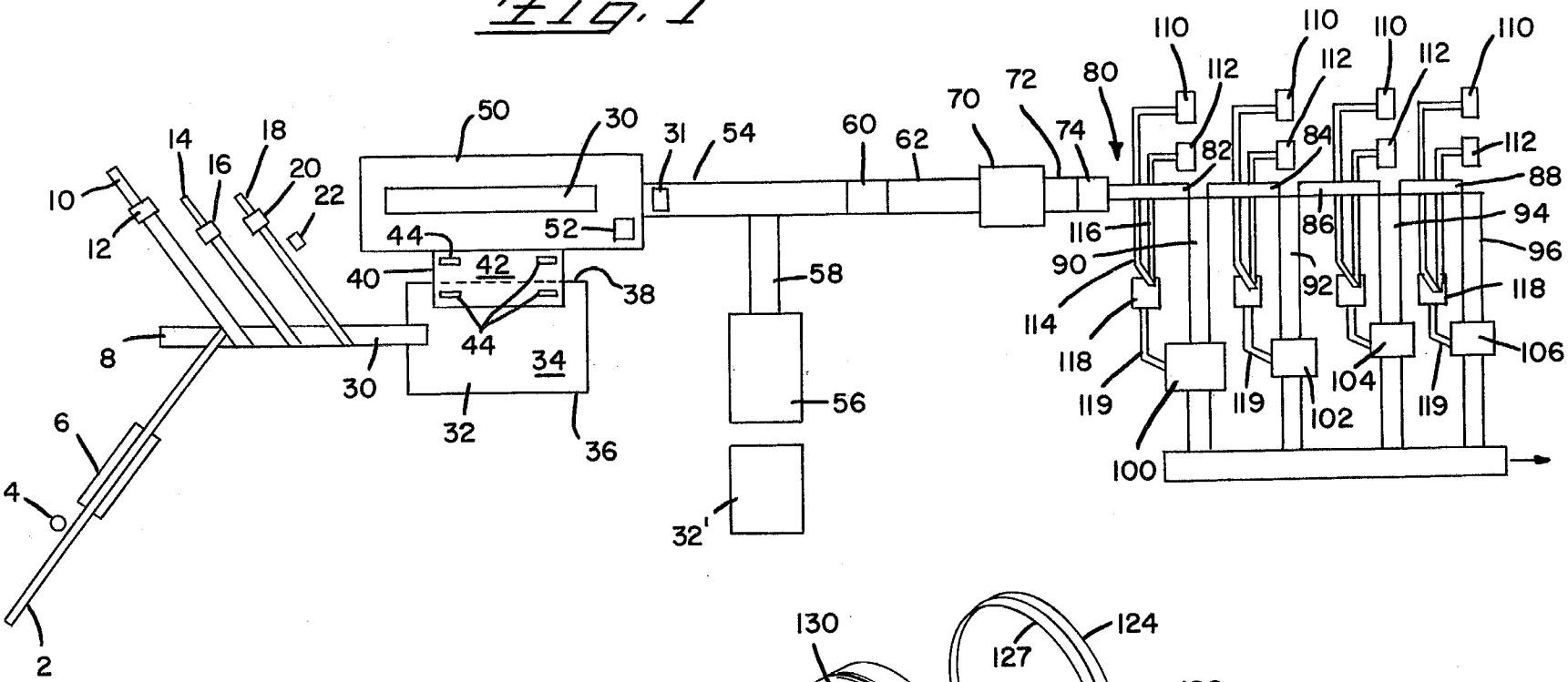
FIG. 1 is a schematic diagram of the manufacturing line according to the instant invention.

The preferred embodiment, of the assembly line is depicted graphically in FIG. 1. The preferred embodiment as depicted in FIG. 1, employs commercially available composite can manfacturing apparatus which will be described in more detail when applicable.

Referring now to FIG. 1, there is shown a supply of aluminum liner 2. Inner liner 2 is an aluminum foil liner which is known in the art. The liner 2 is passed beneath a lubricating station 4, which deposits a measured amount of a mineral oil lubricant thereon. The lubricant deposited by the lubrication station 4 is an approved lubricant which is tasteless and meets all the requirements of the Food and Drug Administration regulations. After lubrication, the foil liner 2 is passed through a heating station 6. The heating station 6 heats one edge of the aluminum foil and puts a slight fold in the opposite edge of the aluminum foil. This is done so that when the aluminum foil is wrapped about the mandrel 8, there will be foil to foil contact and a seal will be achieved between the heated foil and the folded foil. The inner foil 2 is wrapped about the mandrel 8 in the usual fashion. The mandrel 8 in the preferred embodiment is a stainless steel mandrel which is water cooled.

As can be seen in FIG. 1, there are three plys which are placed on the mandrel 8 after the foil has been placed thereon. The first ply 10 is Kraft paper of which is passed through a gluing station 12. Gluing station 12 is a common gluing station which is known in the art and available from Tools & Machinery Builders, Inc., P.O. Box 154, Arcadia, MO 63621.

The Kraft paper 10 after passing through the gluing station 12 is wrapped about the mandrel 8 and the foil liner 2. A second ply of Kraft paper 14 goes through a gluing station 16 and is then wrapped about the mandrel, foil and first ply. After the second ply of Kraft paper has been applied to the mandrel, a label 18 which has been preglued in the gluing station 20, is applied to the mandrel. A sensing station 22 is located forward of the gluing station 20 associated with the label 18. The sensing station 22, has a light sensitive sensor which reads markings placed on the label 18. The markings are placed on the label 18 at designated distances along the label. The distance which has been designated assures that a complete label exists between adjacent marks. In this manner, it is possible to synchronize the cutting operation of the stick produced on the mandrel 8 so that a plurality of container tubes will be produced before the product is cut and removed from the mandrel 8.

In the preferred embodiment, there are six tubes or containers produced in a single mandrel winding or stick. However, it can be appreciated that depending on the height or length of the tube, this number will vary. The stick winding apparatus is a standard apparatus in the composite container industry and will be well known to those skilled in the art.

The finished stick 30 is severed from the mandrel 8 and ejected into a stick hopper. Stick hopper 32 is essentially a large bin located at the product end of the winding mandrel for collection of sticks therein. The sticks 30 as they are removed from the mandrel 8 are driven forward for a pre-set length so that the lead end of the stick will drop into the hopper 32 before the trailing end of the stick 30 is released from the mandrel 8. As the second or the near end of the stick 30 is released from the mandrel, the stick will fall horizontally into the hopper 32. The purpose of this positioning is to assure that the sticks 30 as they fall into the hopper are in a prescribed alignment so that the labels will not become reversed or mixed within the hopper. The floor 34 of hopper 32 is slanted downward from the outer wall 36 to inner wall 38. This is done to urge the supply of sticks 30 toward wall 38 and to provide a constant supply of sticks to stick conveyor means 40 which is disposed in the hopper 32 adjacent wall 38. Conveyor means 40 is a continuous belt 42 having disposed thereon a plurality of flexible fingers 44. The flexible fingers 44 will move into the supply of sticks within hopper 32. On each rotation through the hopper 32 the fingers 44 will pick up a single stick and bias it back against belt 42 so that it is conveyed upward and into an automatic recutter 50. Automatic recutter 50 is a commercial apparatus available from John Eppler Machine Works, Inc., 9150 State Road, Philadelphia, Pa.

Recutter 50 will cut the stick 30 into a plurality of tubes each of which is a predetermined size for a single container. The tubes as they are moved from the automatic cutting operator 50, are turned perpendicular to the position which they occupy on the recutter and located on the conveyor means for further operation.

The alignment of the recut cylinders in the perpendicular position is achieved by having a small path interference position 52 disposed immediate to the conveyor 54. The station 52 is simply a device which catches the leading inside edge of the tube and causes the tube to rotate about a temporarily fixed point. The recut tube rotates about the fixed point and then falls onto the conveyor 54, which is confined on both sides and assures that the recut tubes will be maintained in alignment. Thus, it can be seen that the interference position 52 assures all the containers will enter the conveyor 54 with their labels in a proper alignment.

As can be appreciated, in the manufacture of any product, quality control is an essential feature. In the production of composite cans or containers it is frequently found that a blemished label or scarred label will be wrapped about the mandrel 8 and incorporated in the stick 30 which is deposited in the hopper 32. In order to eliminate defective or unqualified containers at the earliest point, an inspector or operator is stationed near hopper 32. Upon sighting a defective stick 30, the operator will remove the stick from hopper 32 and place it in a manual recut hopper 32'. As time permits, the operator takes the rejected stick from the manual hopper 32' and cuts the defective product from the stick using manual recutter 56. The product from manual recutter 56 is then placed on conveyor 58. Conveyor 58 adjoins conveyor 54. It can be appreciated that the operator must assure that the product placed on conveyor 58 is oriented in the same manner as the product on conveyor 54. The combined product on conveyor 54 is then presented to an elevating conveyor 60.

The elevating conveyor 60 is two opposed belts which are positioned so as to contact two walls of the tube. By adjusting the conveyor belts to achieve a spacing less than the outside diameter of the tube enough friction is generated between the belts and the tube to achieve sufficient compression so that the tube will be transported by the belt. The tubes are elevated to a height of approximately 12 feet and are then placed on a gravity track conveyor 62. This conveyor means is simply two tracks which are spaced apart, a distance slightly greater than the diameter of the tube. The conveyor 62, is acurately shaped and supplies tubes to a flaring apparatus 70.

Flaring apparatus 70 is commercially available. The flaring apparatus 70 will flare the ends of the tube outwardly so that closures may be applied to the ends of the tube. The flaring technique is known to those skilled in the art.

After the tubes have been flared in flaring apparatus 70 they are moved via gravity slide 72 to the base of an elevator conveyor 74. Elevator conveyor 74 is similar to elevator conveyor 60. Elevator conveyor 74 will move to flared tubes approximately 12 feet above the floor as did elevator conveyor 60 and deposit the flared tubes on a distribution conveyor 80.

Distribution conveyor 80 is actually a plurality of smaller conveyor systems 82, 84, 86 and 88, which are disposed adjacent to a plurality of magazines 90, 92, 94 and 96, respectively. The flared tubes which are presented to conveyor 82 will be moved in what would be a rightward direction in FIG. 1 and are placed in the magazine 90. As the magazine 90 becomes filled to capacity the last tube placed therein will form in effect a conveying means so that the next tube will pass over the last tube in magazine 90 and move on to conveyor 84. The tubes which are positioned on conveyor 84 will then fill magazine 92 which will then provide tubes for conveyor 86 to fill magazine 94. Conveyor 88 will be provided tubes to fill magazine 96. Thus, as can be readily appreciated, this is a spill over type system which will provide flared tubes upon demand. As each magazine, 90 to 96 respectively, is filled the conveyor will then become basically a solid conveyor at that position and flared tubes will progress down the conveyor means for distribution to the next available magazine. Each of the magazines 92, 94 and 96 is a gravity feed system.

The flared tubes which are presented at the entrance to the magazine are disposed parallel to the flared tubes proceeding down the distribution conveyor 80. In a first "S" curve the flared tubes within the magazines are rotated such that the flared ends of the tube disposed in the center portion of the "S" curve, are perpendicular to those which are proceeding down the distribution of conveyor 80. At the far end of the magazine which is disposed nearest the seaming station, a second "S" curve stands the flared tube in a vertical position such that the flared tube is now 90° rotated from the position is initially occupied on the distribution conveyor 80. In this manner the flared tube 30 is now in position for presentation to the seamers, 100 through 106 respectively. Seamers such as 100 through 106 are available from Tools & Machinery Builders, Inc.

Also associated with each seamer is an assembly station which assembles a ring and plunger closure and presents it to the seamer for attachment to the flared tube. The closure assembly station has a first vibratory hopper 110 and a second vibratory hopper 112. Vibratory hopper 110 dispenses plunger members to a conveyor 114 and vibratory hopper 112 dispenses ring members to conveyor 116. The free end of conveyor 116 is positioned below and slightly behind the free end of conveyor 114. Both conveyors are positioned immediate to one end of assembly apparatus 118. Assembly apparatus 118 has a plurality of assembly positions which receive a ring member from conveyor 116 and a plunger member from conveyor 114. The ring and plunger are then compressed to form a sealing closure which is conveyed to the sealer 100–106 via conveyor 119. The apparatus for assembling the ring and plunger closure is available from Triad Mold & Die Company, Dayton, Ohio. The vibratory hoppers are available from Moorefeed Corporation, Indianapolis, Ind.

Figure 2:
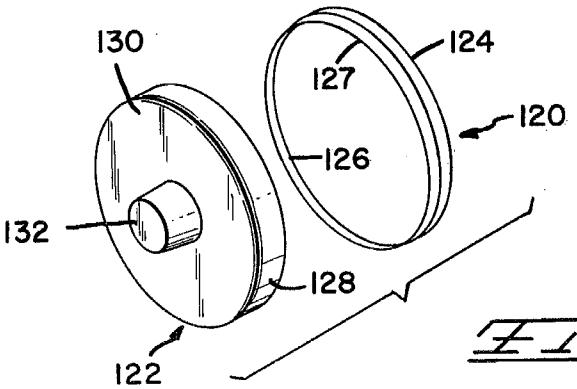
FIG. 2 is an exploded view of a ring and plunger assembly.

The closure assembly which is affixed to the container in the instant invention is shown in an exploded view in FIG. 2. Ring member 120 is shown with the plunger member 122 disposed above it. The ring member 120 has a shoulder portion 124 for seaming about the tube by the seamers 100–106 as is known in the art. An upstanding portion 126 is integral with shoulder portions 124 and is dimensioned to achieve a snug fit within the plunger member 122. An inwardly tapered lead edge 127 establishes the initial orientation of plunger member 122 to upstanding position 126. Plunger member 122 has side wall portion 128 which is dimensioned to fit snugly over the upstanding portion 126 of ring member 120. A cap portion 130 is integral with side portion 128. Forward projecting tip 132 extends from the surface cap 130.

The configuration of the plunger member 122 in the preferred embodiment is such that it will mate with a dispensing spout closure which will be attached by the end user after filling. It will be obvious that the configuration of the plunger member 122 may be altered or modified to meet a particular dispensing spout.

The critical feature in the assembly of the plunger 122 and ring member 120, in the preferred embodiment, is a snug fit of plunger member 122 about the ring member 120. The closure assembly must seal the container during shipping and storage; however plunger member 122 must be such that it will separate away from the ring member 120 in use without causing damage to either the container or the ring member 120. The ring and plunger assembly is such that when assembled to the tube it will not add appreciably to the volume occupied by the tube. All of the plunger member 122 will be contained within the tube and only a very slight portion of the ring member 120 will extend beyond the tube. Thus, there is virtually no appreciable change in the volume occupied by the tube after attachment of the ring and plunger assembly and no appreciable change in shipping volume.

What is claimed is:

1. An assembly method for forming a composite container having in one end thereof a closure, said method comprising the steps of:

(a) forming a stick on a mandrel;
(b) collecting the stick of step (a) in a hopper;
(c) conveying the stick from the hopper of step (b), on a figured conveyor means to a recutter;
(d) cutting said stick in said recutter into a plurality of containers having a predetermined length;
(e) conveying in an elevator conveyor the containers of step (d) to a predetermined height above said recutter;
(f) conveying by gravity said containers from said predetermined height to a flarer station;
(g) flaring at least one end of said container in said flarer;
(h) providing a seamer;
(i) providing a ring and plunger closure assembly apparatus for supplying ring and plunger closures;
(j) conveying in an elevator conveyor said containers of step (f) to a predetermined height above said seamer;
(k) providing said containers of step (j) and said closure of step (i) to said seamer; and
(l) seaming said closure to said container in said seamer.

* * * * *